United States Patent [19]

Ishimaru et al.

[11] 4,360,150

[45] Nov. 23, 1982

[54] CENTRIFUGE APPARATUS FOR REORIENTING GRADIENTS

[75] Inventors: Kenzo Ishimaru, San Jose; Steven T. Nielsen, Sunnyvale, both of Calif.

[73] Assignee: Beckman Instruments, Inc., Fullerton, Calif.

[21] Appl. No.: 274,970

[22] Filed: Jun. 18, 1981

[51] Int. Cl.[3] ..... B04B 9/12

[52] U.S. Cl. ..... 233/26

[58] Field of Search ..... 233/26, 1 R, 27, 28, 233/1 A, 1 B; 422/72

[56] References Cited

U.S. PATENT DOCUMENTS 4,290,550 9/1981 Chulay ..... 233/26

4,304,356 12/1981 Chulay ..... 233/26

*Primary Examiner*—Robert W. Jenkins

*Attorney, Agent, or Firm*—R. J. Steinmeyer; F. L. Mehlhoff; Al A. Canzoneri

[57] ABSTRACT

A centrifuge rotor and sample containers for reorienting gradients and separating the components of a sample. The rotor contains a plurality of cylindrical recesses equally spaced about its rotational axis. The recesses are open at the top and have a concave hemispherical bottom. A cylindrical plug member is positioned in each of the recesses, and the lowermost end of the cylindrical plug member is formed in the shape of a concave hemisphere. A sample container in the shape of a hollow sphere is positioned between the hemisphere of the cylindrical plug member and the hemisphere of the recess bottom, and means are provided to retain the cylindrical plug member in the recess. The symmetry of the hemispherically shaped sample container is advantageous for minimizing any disturbance to a gradient during reorientation. In another embodiment, a centrifuge rotor is provided which is adapted for fixed angle centrifugation with hemispherical sample containers. In yet another embodiment, a centrifuge rotor is adapted for centrifugation with more than one hemispherical sample container in each recess of a "vertical tube" type rotor.

7 Claims, 5 Drawing Figures

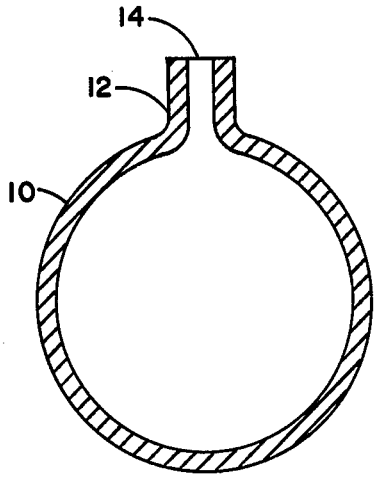
FIG. 1
FIG. 2
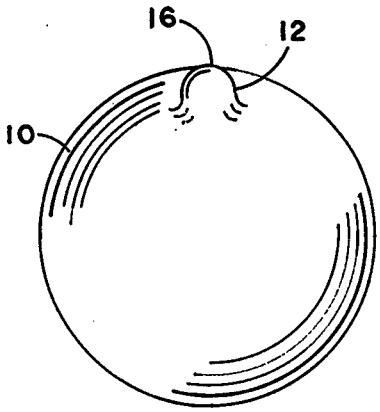

CENTRIFUGE APPARATUS FOR REORIENTING GRADIENTS

This invention relates to centrifuges and more particularly to apparatus for reorienting density gradients.

BACKGROUND OF THE INVENTION

Density gradient centrifugation is a well known process for separating particles contained in a liquid sample. In this process, the particles become suspended in a fluid column of progressively increasing density.

Two methods of density gradient centrifugation are in general use. In the method known as the rate zonal technique, a sample solution containing particles to be separated is layered on a pre-formed gradient column. When centrifugal force is applied, the particles sediment through the gradient in separate zones, so that each zone becomes populated by particles of a specific density. In the rate zonal method, it is necessary that the density of the particles be greater than the density of the gradient, and that the centrifugation be terminated before the particles strike the bottom or the wall of the tube.

Another method of density gradient centrifugation is known as the isopycnic technique. In this method, a particle sediments to a point in the centrifuge tube at which the density of the gradient is the same as the density of the particle. Upon reaching this state of equilibrium, the particles will not sediment further along the column irrespective of how much additional centrifugation is carried out.

Currently, tube carrying rotors as well as bowl type zonal rotors are used for making density gradient separations. The following discussion is limited to tube carrying rotors of which there are three main types: swinging bucket rotors, fixed angle rotors and vertical tube rotors. Of these, it is only in the last two types that reorientation of the tube contents takes place; first, when centrifugal force is applied, and again when it is withdrawn. Thus, a gradient consisting of a vertically stacked column of fluid reorients to a horizontally stacked column during centrifugation and then reorients again in a vertical arrangement at the conclusion of centrifugation. As previously stated, reorientation does not occur in swinging bucket type rotors because in such rotors the centrifuge tube is always oriented in the direction of the force field.

A problem which is frequently encountered in making density gradient separations is that remixing of separated particles occurs when the gradient is reoriented. The problem is somewhat more prevalent where vertical tube rotors are used, since their reorientation angle is larger than that of a fixed angle rotor. It has been observed that the cylindrical shape traditionally employed for centrifuge tubes is not ideal to minimize disturbance of a sample during final reorientation. This is so, because shear stresses act on the separation zone when rotation of the gradient takes place in a non-symmetrical envelope. This can be visualized by noting that reorientation in an elongated cylindrical container results in substantial change in zone width and thickness.

Accordingly, the present invention is directed to a sample container used in reorienting gradient centrifugation which overcomes the problems of the prior art.

SUMMARY OF THE INVENTION

In accordance with the present invention, there is disclosed a centrifuge having a rotor and sample containers for reorienting gradients and separating the components of a sample. The rotor contains a plurality of cylindrical recesses equally spaced around the rotational axis of the rotor. The recesses are open at the top and have a concave hemispherical bottom. A cylindrical plug member is positioned in each of the recesses, and the lowermost end of the cylindrical plug member is formed in the shape of a concave hemisphere. A sample container in the shape of a hollow sphere is positioned between the hemisphere of the cylindrical plug member and the hemisphere of the recess bottom, and means are provided for retaining the cylindrical plug member in the recess.

BRIEF DESCRIPTION OF THE DRAWINGS

FIG. 1 is a cross-sectional view of the sample container of the invention before the filler neck is sealed.

FIG. 2 is a perspective view of the sample container of the invention after the filler neck is sealed.

DETAIED DESCRIPTION

In FIG. 1, there is shown a cross-sectional view of the sample container 10 of the invention. The container 10 is formed in the shape of a hollow sphere, and, in the preferred embodiment, has a filler neck 12 containing an opening 14 by which the container is filled. The container 10 may be formed by blow molding or rotation molding a suitable thermoplastic material such as polyallomer. Use of such a thermoplastic material enables the filler neck 12 to be fusion sealed by means of a heated form as shown in U.S. Pat. No. 4,285,904 to Sharples, et at., entitled "Method and Apparatus for Sealing Centrifuge Tubes" assigned to Beckman Instruments, Inc., the assignee of the present invention. FIG. 2 is a perspective view of the container 10 after it has been filled and the filler neck 12 has been sealed with a rounded closure 16.

Figure 3:
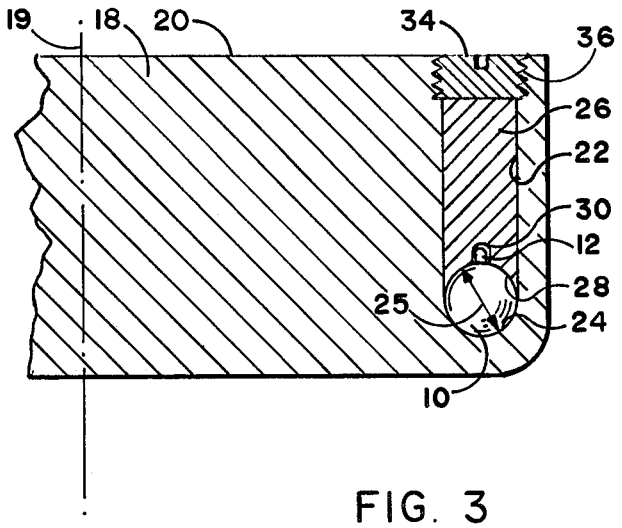
FIG. 3 is a fragmentary and generally schematic cross-sectional representation of a centrifuge and rotor constructed in accordance with one embodiment of this invention.

Turning now to FIG. 3, there is shown in a somewhat schematic cross-sectional view, a portion of a centrifuge rotor 18 having an axis of rotation 19, a top surface 20, and a plurality of cylindrical recesses 22 equally spaced and generally parallel with the rotor axis of rotation 19. Each recess 22 is open at the top and has a concave hemispherical bottom 24. A cylindrical member 26 is disposed in each recess 22. The lower end of each cylindrical plug member 26 is formed in the shape of a concave hemisphere 28, and this surface in conjunction with the hemispherical bottom 24 of the recess 22 forms a spherical cavity 25 for receiving a spherical sample container 10. The conforming shape of the spherical cavity 25 ensures that the spherical container 10 will not be distorted by the forces of centrifugation. While the main forces developed in centrifugation are in a radial direction, in "vertical tube" type rotors strong hydrostatic forces are also developed in the sample container. In the centrifuge of the present invention, forces in the upward direction are resisted by a threaded plug 34 which engages screw threads 36 at the mouth of recess 22.

In operation, the spherical container 10 is filled through the filler neck 12 with a suitable fluid gradient, and the liquid sample containing the particles to be separated is layered on top of the gradient. The filler neck 12 of the sample container is then sealed by means of a heated form (not shown), which imparts a rounded closure 16 to the filler neck 12. The sample container 10 is then positioned in one of the recesses 22 of the centrifuge rotor 20. Next, the cylindrical plug member 26 is placed in the recess with clearance hole 30 engaging the filler neck 12 of the sample container 10. And finally, the threaded plug 34 is assembled into the mouth of recess 22. The procedure is repeated in a symmetrical pattern to assure that rotor balance is maintained.

Figure 4:
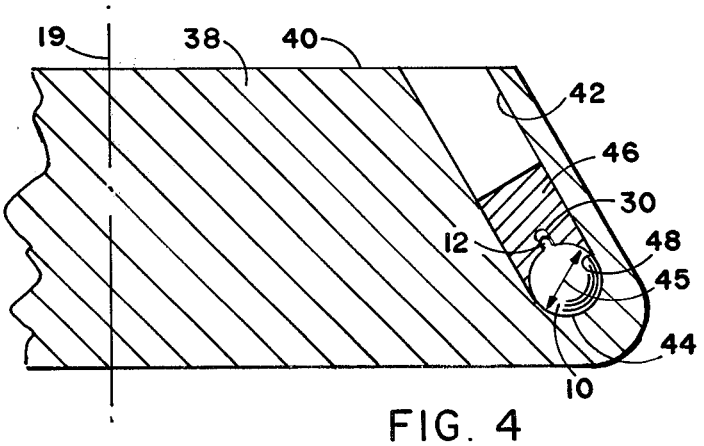
FIG. 4 is a fragmentary and generally schematic cross-sectional representation of a centrifuge and rotor constructed in accordance with another embodiment of the invention.

Turning now to FIG. 4, the invention is shown in another embodiment having application to a "fixed angle" type rotor. There is shown in a somewhat schematic cross-sectional view a portion of a centrifuge rotor 38 having a spin axis 19, a top surface 40, and a plurality of cylindrical recesses 42 equally spaced and at a fixed angle with respect to the axis of rotation 19. Each recess 42 is open at the top and has a concave hemispherical bottom 44. A cylindrical plug member 46 is disposed in each recess 42. The lower end of each cylindrical member 46 is formed in the shape of a concave hemisphere 48, and this surface in conjunction with the hemispherical bottom 44 of the recess 42 forms a spherical cavity 45 for receiving a spherical sample container 10. During centrifugation, a downward component force is developed in the cylindrical plug member 46. This downward force opposes the upward force developed in the sample container 10. The consequence of this fact is that the mass of the cylindrical plug member 46 can be made large enough so that the developed downward force is greater than the upward force, thereby making it unnecessary to employ a fixed restraint such as the screw plug 34 of FIG. 3.

Figure 5:
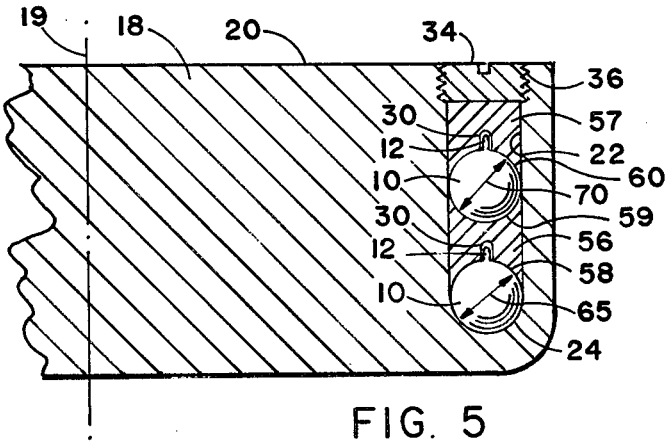
FIG. 5 is a fragmentary and generally schematic representation of a centrifuge and rotor constructed in yet another embodiment of the invention.

Turning now to FIG. 5, the invention is depicted in yet another embodiment which provides for the centrifugation of more than one sample container in each recess of a "vertical tube" type rotor. There is shown a centrifuge rotor 18 of the type shown in FIG. 3, in which a first cylindrical member 56 is disposed in the lower portion of the recess 22, and a second cylindrical member 57 is disposed above the first. Both ends 58 and 59 of the first cylindrical member 56 are formed in the shape of a concave hemisphere as is the lower end 60 of the second cylindrical member 57 and the bottom 24 of the cylindrical recess 22. The face-to-face arrangement of hemispheres 24 and 58 form a first spherical cavity 65, and, similarly, the face-to-face arrangement of hemispheres 59 and 60 form a second spherical cavity 70. A clearance hole 30 for engaging the filler neck 12 of the spherical container 10 is provided at the lower end 58 of the first cylindrical member 56 and in the lower end 60 of the second cylindrical member 57. As in the single container embodiment depicted in FIG. 3, a screw plug 34 engages the rotor screw threads 36 and serves to resist the vertical forces developed in centrifugation and retains the cylindrical members 56 and 57 in the recess 22. Although the foregoing embodiment is illustrated with respect to a "vertical tube" type rotor, it is to be understood that a "fixed angle" type rotor can also be employed if used with properly designed cylindrical plug members positioned to form two or more spherical cavities within the angularly disposed recesses of a "fixed angle" rotor.

While in accordance with the patent statutes there has been described what at present is considered to be the preferred embodiments of the invention, it will be understood by those skilled in the art that various changes and modifications may be made therein without departing from the invention and it is, therefore, the aim of the appended claims to cover all such changes and modifications as fall within the true spirit and scope of the invention.

We claim:

1. A centrifuge having a rotor and sample containers for reorienting gradients and separating the components of a sample, the combination comprising:

a rotor having a top surface containing a plurality of cylindrical recesses equally spaced with respect to the rotational axis of said rotor;

said recesses being open at the top and having a concave hemispherical bottom;

a sample container formed in the shape of a hollow sphere disposed in each said cylindrical recess and supported by the hemispherical bottom of said recess;

a cylindrical plug member having its lowermost end formed in the shape of a concave hemisphere, and said end engaging the upper surface of said sample container.

2. The centrifuge as recited in claim 1 including means for retaining said cylindrical plug member in said recess.

3. The centrifuge recited in claim 2 wherein said means for retaining said cylindrical plug member in said recess comprises a threaded plug engaging screw threads at the mouth of said recess.

4. A centrifuge having a rotor and sample containers for reorienting gradients and separating the components of a sample, the combination comprising:

a rotor having a top surface containing a plurality of cylindrical recesses, said recesses equally spaced, and generally parallel with the rotational axis of said rotor;

said recesses being open at the top and having a concave hemispherical bottom;

a sample container formed in the shape of a hollow sphere disposed in the spherical cavity of each said recess, and supported by the hemispherical bottom of said recess;

a cylindrical plug member having its lowermost end formed in the shape of a concave hemisphere, and said end engaging the upper surface of said sample container; and means for retaining said cylindrical plug member in said recess wherein said means comprises a threaded plug engaging screw threads in the mouth of said recess.

5. A centrifuge having a rotor and sample containers for reorienting gradients and separating the components of a sample, the combination comprising:

a rotor having a top surface containing a plurality of cylindrical recesses equally spaced, and oriented at a fixed angle with respect to the rotational axis of said rotor;

said recesses being open at the top and having a concave hemispherical bottom;

a sample container formed in the shape of a hollow sphere disposed in each said recess and supported by said concave hemispherical bottom; and a cylindrical plug member having its lowermost end formed in the shape of a concave hemisphere, and said end engaging the upper surface of said sample container.

6. A centrifuge having a rotor and sample containers for reorienting gradients and separating the components of a sample, the combination comprising:

a first sample container formed in the shape of a hollow sphere disposed in each said cylindrical recess and supported by said concave hemispherical bottom;

a first cylindrical plug member having both ends formed in the shape of a concave hemisphere, the lowermost end engaging the upper surface of said first sample container;

a second sample container formed in the shape of a hollow sphere disposed in each said cylindrical recess on top of said first cylindrical plug member and supported by the hemispherical end of said cylindrical plug member;

a second cylindrical plug member having its lowermost end formed in the shape of a concave hemisphere, said lowermost end engaging the upper surface of said second sample container; and means for retaining said first and second cylindrical plug members in each said recess.

7. The centrifuge recited in claim 6 wherein said means for retaining said first and second cylindrical members in each said recess comprises a threaded plug engaging screw threads at the mouth of each said recess.

* * * * *